US008663549B2

(12) United States Patent
Ohishi et al.

(10) Patent No.: US 8,663,549 B2
(45) Date of Patent: Mar. 4, 2014

(54) HEAT-RESISTING STEEL FOR ENGINE VALVES EXCELLENT IN HIGH-TEMPERATURE STRENGTH

(75) Inventors: Katsuhiko Ohishi, Yasugi (JP); Akihiro Toji, Yasugi (JP)

(73) Assignees: Hitachi Metals, Ltd., Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/998,209

(22) PCT Filed: Jun. 23, 2010

(86) PCT No.: PCT/JP2010/060602

§ 371 (c)(1), (2), (4) Date: Mar. 25, 2011

(87) PCT Pub. No.: WO2010/150795

PCT Pub. Date: Dec. 29, 2010

(65) Prior Publication Data

US 2011/0182764 A1 Jul. 28, 2011

(30) Foreign Application Priority Data

Jun. 24, 2009 (JP) ..... 2009-149420

(51) Int. Cl.
*C22C 38/42* (2006.01)
*C22C 38/44* (2006.01)
*C22C 38/48* (2006.01)

(52) U.S. Cl.
USPC ..... 420/42; 420/45; 420/47; 420/48; 420/49; 420/53; 420/55

(58) Field of Classification Search
USPC ..... 420/42, 43–71, 87; 148/327
See application file for complete search history.

(56) References Cited

U.S. PATENT DOCUMENTS

| | | | | |
|---|---|---|---|---|
| 2,686,116 | A * | 8/1954 | Schempp et al. | 420/42 |
| 3,969,109 | A | 7/1976 | Tanczyn | |
| 2002/0061257 | A1 | 5/2002 | Hamano et al. | |

FOREIGN PATENT DOCUMENTS

| | | | |
|---|---|---|---|
| EP | 2 048 255 | A1 | 4/2009 |
| JP | 37-14609 | | 9/1962 |
| JP | 41-8043 | | 4/1966 |
| JP | 51-30525 | | 3/1976 |
| JP | 51-44505 | | 4/1976 |
| JP | 51040321 | A * | 4/1976 |
| JP | 52-71325 | | 6/1977 |
| JP | 03-177543 | | 8/1991 |
| JP | 2001-323323 | | 11/2001 |
| JP | 2002-294411 | | 10/2002 |

OTHER PUBLICATIONS

English abstract of Japanese patent 51040321, Derwent publication, Apr. 5, 1976.*
English-hand translation of Japanese patent 51040321, Kunio Kusaka et al., Apr. 5, 1976.*
International Search Report for PCT/JP2010/060602, mailed Sep. 7, 2010.
Chinese Office Action issued Aug. 2, 2012 for corresponding Chinese application No. 201080002624.7.
European Search Report mailed Dec. 4, 2012 for corresponding EP application EP 10 79 2113.

* cited by examiner

*Primary Examiner* — Deborah Yee

(57) ABSTRACT

To provide an inexpensive heat-resisting steel for engine valves by causing Fe-based heat-resisting steel to exhibit high temperature strength not inferior to that of Ni-based heat-resisting steel. A heat-resisting steel for engine valves excellent in high temperature strength containing, in % by mass, C: 0.20 to 0.50%, Si: 1.0% or less, Mn: 5.0% or less, P: 0.1 to 0.5%, Ni: 8.0 to 15.0%, Cr: 16.0 to 25.0%, Mo: 2.0% or less (including 0%), Cu: 0.5% or less, Nb: 1.0% or less (including 0%), W: 2.0% or less (including 0%), N: 0.02 to 0.30%, B: 0.01% or less, and remnants of Fe and impurities, wherein the heat-resisting steel for engine valves satisfies formulae below:

$$156.42P(\%)+0.91Mo(\%)+0.73W(\%)-12.27Nb(\%)+220.96N(\%)+120.59\geq 170 \quad \text{Formula (1)}$$

$$13.70P(\%)-6.97Mo(\%)-4.32W(\%)-3.29Nb(\%)+119.10N(\%)+27.75\geq 25 \quad \text{Formula (2).}$$

16 Claims, No Drawings

HEAT-RESISTING STEEL FOR ENGINE VALVES EXCELLENT IN HIGH-TEMPERATURE STRENGTH

CROSS REFERENCE TO RELATED APPLICATIONS

This application claims the benefit under 35 U.S.C. Section 371, of PCT International Application Number PCT/JP2010/060602, filed Jun. 23, 2010 and Japanese Application No. 2009-149420, filed Jun. 24, 2009 in Japan, the contents of which are incorporated herein by reference.

TECHNICAL FIELD

The present invention relates to a heat-resisting steel for engine valves excellent in high temperature fatigue strength, and, in particular, to a heat-resisting steel for engine valves used for automobile internal combustion engines.

BACKGROUND ART

Conventionally, as heat-resisting steels for exhaust valves of automobile engine valves, there have widely been used 21-4N steel (JIS specification: SUH35), that is, a high Mn heat-resisting steel, and improved steels thereof which are good high temperature strength and oxidation resistance, and low cost.

For the face part of engine valves, high wear resistance is required because of continual contact with a valve seat. Accordingly, for the face part of valves using the 21-4N steel or improved steels thereof, usually, the built-up of Stellite etc. is done to thereby reinforce the hardness and wear resistance at high temperatures.

Moreover, as a valve material used for portions exposed to a higher load, there is used in part a precipitation strengthening-type heat-resisting alloy including a lot of Ni and having an enhanced high temperature strength by precipitating γ' (gamma prim) being an intermetallic compound, or NCF751 being a super heat-resisting alloy. However, since these alloys contain a lot of Ni, there is such a problem of increasing the cost.

However, as the result of the tightening of environmental regulations in recent years, the efficiency and power of gasoline engines are enhanced to raise the combustion temperature, and therefore, a request is placed for a heat-resisting steel for valves which is low cost and excellent in high temperature strength as compared with the above-described heat-resisting alloys.

In order to answer the request, Japanese Patent Application Laid-Open No. 2001-323323 (Patent Document 1) proposes a production method of an engine valve, in which a base material formed by adding appropriately Mo, Nb and V besides C, N, Mn, Ni and Cr to a base of inexpensive Fe-based heat-resisting steel, and suppressing as much as possible the use of expensive raw materials such as Ni is used, which is subjected to a solution heat treatment at 1100 to 1180° C. and, after that, is subjected to forging in a temperature range of 700 to 1000° C. to form a valve having been subjected to an aging treatment of accumulating residual strain by machining intended for strain age hardening, thereby enhancing the hardness of the face part of the engine valve to 400 HV or more and controlling the overaging and softening even in the use in high temperature regions.

Furthermore, Japanese Patent Application Laid-Open No. 2002-294411 (Patent Document 2) and Japanese Patent Application Laid-Open No. 3-177543 (Patent Document 3) propose engine valve materials obtained by adding, as an improved material of 21-4N steel being a high Mn heat-resisting steel, alloying elements such as Mo, W, Nb and V to thereby promote solid solution strengthening or precipitation strengthening and to improve high temperature strength and wear resistance.

Patent Document 1: Japanese Patent Application Laid-Open No. 2001-323323

Patent Document 2: Japanese Patent Application Laid-Open No. 2002-294411

Patent Document 3: Japanese Patent Application Laid-Open No. 3-177543

DISCLOSURE OF THE INVENTION

The alloy disclosed in Patent Document 1 is advantageous in the material cost because it uses an Fe-based heat-resisting steel as a base. However, the cost advantage may be inversely weakened since the accumulation of strain in the material is necessary in the production process of the valve, a solution heat treatment at high temperatures is necessary because of the utilization of the precipitation strengthening based on nitride, and strict temperature management and production management are required.

Furthermore, alloys disclosed in Patent Documents 2 or 3 are provided with more excellent high temperature strength than conventional 21-4N steel, but are insufficient in the strength as an engine valve material to be applied at raised combustion temperatures of recent years.

A purpose of the present invention is to provide low cost heat-resisting steel for engine valves by realizing high temperature strength not inferior to that of Ni-based heat-resisting alloys by means of an Fe-based heat-resisting steel.

The present inventor has studied hard on the relation between the high temperature strength and various alloying elements while using an Fe-based heat-resisting steel as a base, and, as the result, has found that, by performing the strict control of addition amount of P, Mo, W, Nb and N, as well as exactly the strict control of mutual relation thereof, extremely good high temperature strength can be obtained, thus having achieved the present invention.

That is, the present invention is a heat-resisting steel for engine valves excellent in high temperature strength, having, in % by mass, C: 0.20 to 0.50%, Si: 1.0% or less, Mn: 5.0% or less, P: 0.1 to 0.5%, Ni: 8.0 to 15.0%, Cr: 16.0 to 25.0%, Cu: 0.5% or less, Nb: 0.03% or more and 1.0% or less, W: 2.0% or less (including 0%), Mo: 0.03% or more and less than 2.0%, N: 0.02 to 0.30%, B: 0.01% or less, and the remnants of Fe and impurities, wherein the heat-resisting steel for engine valves satisfies Formulae below:

$$156.42P(\%)+0.91Mo(\%)+0.73W(\%)-12.27Nb(\%)+220.96N(\%)+120.59\geq 170 \quad \text{Formula (1)}$$

$$13.70P(\%)-6.97Mo(\%)-4.32W(\%)-3.29Nb(\%)+119.10N(\%)+27.7\geq 25 \quad \text{Formula (2).}$$

In the present invention, preferable ranges of P, Mo and Nb are as follows.

P: more than 0.15% to 0.5% or less

Mo: 0.03 to 1.6%

Nb: 0.03 to 0.2%

Among these, for Mo, more preferable range is 0.03 to 1.0%.

The preferable value of Formula (1) is 185 or more, and the preferable value of Formula (2) is 30 or more.

The heat-resisting steel for engine valves of the present invention makes it possible to cause an Fe-based heat-resisting steel to express a high temperature strength not inferior to that of Ni-based heat-resisting alloys, and, therefore, contributes largely to the cost reduction of heat-resisting steel for engine valves.

BEST MODES FOR CARRYING OUT THE INVENTION

The present invention was achieved based on the above-mentioned new knowledge. Hereinafter, the action of respective elements in the present invention will be described.

In a heat-resisting steel for engine valves of the present invention, respective chemical compositions are defined because of reasons below. Meanwhile, they are denoted by % by mass, unless otherwise specified.

C: 0.20 to 0.50%

C dissolves in the matrix in the form of a solid solution to stabilize the γ structure and to increase the strength. Moreover, it precipitates a carbide by an aging treatment to increase the strength at ordinary and high temperatures, and forms Cr carbide in the matrix to contribute also to wear resistance.

When Nb, W or Mo is added, it forms carbides rich in Nb, W or Mo to contribute more reliably to the improvement of the wear resistance. In particular, as the result of the combination of C and Nb, there are such effects that the growth of crystal grains in the solution heat treatment at high temperatures is prevented and the strength in a range of low temperatures is increased.

C of less than 0.20% does not give the above-described effect. On the other hand, the addition exceeding 0.5% does not exhibit more effect on characteristics improvement, and, in addition, too much formation of Cr carbide lowers oxidation resistance and toughness, and lowers the solid solubility of N. Therefore, C is determined to be in 0.2 to 0.5%. The preferable range of C is from more than 0.25% to 0.4% or less.

Si: 1.0% or less

Si acts as a deoxidizing agent during melting, and increases high temperature oxidation resistance. On the other hand, too much addition thereof lowers hot workability and toughness, and encourages the formation of the σ phase. Therefore, Si is determined to be in 1.0% or less. The preferable range of Si is 0.6% or less. Meanwhile, in order to secure the effect obtained by the addition of Si, the lower limit of Si is preferably 0.05%, and the more preferable upper limit is 0.50%.

Mn: 5.0% or less

Mn is a γ-stabilizing element, accelerates work hardening during cold and warm workings, and heightens the solid solubility of N to contribute to the strength improvement. On the other hand, too much addition thereof causes the lowering of hot workability at high temperatures and the lowering of high temperature strength. Therefore, Mn is determined to be in 5.0% or less. The preferable range of Mn is 3.0% or less.

P: 0.1 to 0.5%

P, along with C, accelerates the precipitation of $M_{23}C_6$ type carbide, replaces C to be incorporated into the carbide to thereby increase the lattice constant, thus contributing to the precipitation strengthening. In order to obtain the effect, P is required to be 0.1% or more. However, the addition of P of more than 0.5% causes the lowering of hot workability, grain boundary strength, and toughness. Therefore, P is determined to be in 0.1 to 0.5%. Meanwhile, in order to secure the above-described effect obtained by the addition of P, it is favorable to set the lower limit of P to be in a range of more than 0.15%. The more preferable upper limit of P is 0.4%.

Ni: 8.0 to 15.0%

Ni stabilizes the γ structure of the matrix to improve the strength, corrosion resistance and oxidation resistance, and accelerates work hardening in cold and warm workings. In order to obtain the effect, Ni is required to be in 8.0% or more. On the other hand, the addition of Ni of more than 15.0% not only lowers the solid solubility of N, but also causes the increase in cost. Accordingly, Ni is determined to be in 8.0 to 15.0%. The preferable range of Ni is 9.0 to 11.0%.

Cr: 16.0 to 25.0%

Cr is an indispensable element for improving the corrosion resistance and oxidation resistance of engine valves, and is required to be in 16.0% or more in order to form carbides by an aging treatment to increase the strength at ordinary and high temperatures. But, the addition of Cr of more than 25% causes the formation of a harmful a phase. Accordingly, Cr is determined to be in 16.0 to 25.0%. The preferable lower limit of Cr is 18.0%, and the preferable upper limit thereof is 22.0%.

Cu: 0.5% or less

Cu stabilizes the γ structure of the matrix, improves the toughness in a cold working, and enhances the high temperature strength by the precipitation of a minute Cu phase compound. But, the increase in addition amount of Cu lowers hot workability and oxidation resistance. Accordingly, Cu is determined to be in 0.5% or less. The preferable lower limit of Cu is 0.03%, and the more preferable upper limit is 0.35%.

Nb: 0.03% or more and 1.0% or less

Nb combines with C and N to prevent the grain growth a solution heat treatment at high temperatures, and to improve fatigue strength. Therefore, Nb may be added up to 1.0% as the upper limit. But, the increase in addition amount of Nb increases the amount of solid-solution C and N, to thereby inversely cause the lowering of fatigue strength and the lowering of cold workability because of the formation of lots of carbides and nitrides. Accordingly, the lower limit of Nb may be the limit of being additive-free (that is, including 0%). Meanwhile, in order to secure the above-described effect obtained by the addition of Nb, the lower limit of Nb is favorably determined to be 0.03%. The more preferable upper limit is 0.50% and furthermore, the preferable upper limit is 0.20%.

Mo: 0.03% or more and less than 2.0%

Mo is an element that forms a solid solution in a matrix as a substitutional atom to be strengthened and, at the same time, apart thereof forms carbides to enhance high temperature strength. Mo may be added up to 20% as the upper limit. But, the increase in addition amount of Mo may cause the generation of embrittlement of the alloy. Accordingly, the lower limit of Mo may be the limit of being additive-free (that is, including 0%). Meanwhile, in order to secure the effect obtained by the addition of Mo, the lower limit of Mo is favorably determined to be 0.03%. The preferable upper limit of Mo is 1.6% or less, and the more preferable range of Mo is 1.0% or less.

Moreover, Mo is an element that gives the same function and advantage as W to be described later, but in order to obtain excellent fatigue strength required for engine valve materials, the addition of Mo is advantageous.

In the same manner as Mo, W forms a solid solution in the matrix as a substitutional atom to be strengthened and, at the same time, a part thereof forms carbides to enhance high temperature strength. W basically has the same functions as Mo, but, with regard to oxidation resistance, W is more advantageous. W has an atomic weight twice that of Mo, and, therefore, has a small diffusion rate at high temperatures and a large effect of enhancing creep strength. Therefore, in the case of enhancing creep strength, the addition of W is effective. But, the increase in addition amount of W causes the formation of carbides and nitrides, and does not give a sufficient effect for high temperature strength. Therefore, it is determined to be 2.0% or less. The lower limit of W may be the limit of being additive-free (that is, including 0%), as is the case for Mo.

N, as is the case for C, is an element that stabilizes the γ structure and the most part thereof forms solid solution in the matrix as an interstitial atom to contribute to the strengthening thereof. In order to obtain the effect, 0.02% or more is required. But, when more than 0.30% of N is added, the work hardening in a drawing process becomes significant to thereby cause the lowering of toughness. Accordingly, the range of N is determined to be 0.02 to 0.30%.

B strengthens γ grain boundaries and is effective in improving high temperature strength and creep resisting properties. On the other hand, too much addition thereof lowers the melting temperature of grain boundaries and deteriorates hot workability. Accordingly, B is determined to be in 0.01% or less.

Components other than the above-described elements are Fe and impurities.

In the heat-resisting steel for engine valves of the present invention, an inexpensive Fe-based heat-resisting steel is used as a base, to which alloying elements that contribute to the solid solution strengthening and precipitation strengthening are appropriately added to give high temperature strength. Further, in order to obtain a high-strength state, it is important to control appropriately the amount of P and N to be added which are alloying elements, and the amount of Mo, W or Nb selectively added. Hereinafter, the reason thereof will be described in detail.

With regard to the high temperature strength, which is a property particularly required in engine valve materials, in the case of Ni-based heat-resisting alloys and super heat-resisting alloys, the high temperature strength can be enhanced by changing the γ' precipitation amount or the composition thereof. However, in the case of Fe-based heat-resisting alloys, the reinforcement mechanism thereof is limited to precipitation strengthening mainly by carbides, nitrides etc. and solid solution strengthening by alloying elements. Accordingly, when trying to utilize the reinforcement mechanism such as the precipitation strengthening and solid solution strengthening in a composite manner, properties may be inversely lowered inversely by the interaction of respective elements. Accordingly, as the result of the study on various alloy elements so that these reinforcement mechanisms can be exerted as much as possible, it has become clear that P, N, Mo, W and Nb give much influence on the high temperature strength. Furthermore, the correlation of properties of respective elements was evaluated by the relation based on correct coefficients through the use of the technique of the multiple linear regression analysis. Then, it has been found that the strict control of the relation is necessary.

That is, the content of P, N, Mo, W and Nb in a steel is required to be controlled so as to satisfy the correlation of Formula (1): $156.42\,P(\%)+0.91\,Mo(\%)-0.73\,W(\%)-12.27\,Nb(\%)+220.96\,N(\%)+120.59\geq 170$, in a relation using coefficients.

When the value is smaller than 170, the reinforcement mechanism of respective elements stops acting effectively, to thereby cause the lowering of the high temperature strength, and, furthermore, the lowering of hardness at high temperatures. Meanwhile, by setting the value of Formula (1) to be 185 or more, the high temperature hardness at 800° C. becomes easily 180 HV or more, which allows the lowering of strength and hardness at high temperatures to be further suppressed.

Moreover, by controlling the content of P, Mo, W, Nb and N in the steel so as to satisfy the correlation of Formula (2): $13.70\,P(\%)-6.97\,Mo(\%)-4.32\,W(\%)-3.29\,Nb(\%)+119.10\,N(\%)+27.75\geq 25$, the lowering of high temperature strength, and, furthermore, the lowering of creep strength at high temperatures can be prevented.

When the value becomes smaller than 25, the interaction of respective elements lowers the original reinforcement mechanism to thereby decrease the high temperature strength. A preferable range is such that the value according to Formula (2) is 30 or more.

By appropriately controlling P, N, Mo, W and Nb so as to satisfy the above-described two Formulae, it becomes possible to utilize solid solution strengthening and precipitation strengthening, on which these elements act, to a maximum extent in a composite manner. As the result, a heat-resisting steel for engine valves that is equipped with excellent high temperature strength in combination can be provided. Meanwhile, when the element of Mo, W or Nb is not added, the respective amounts are considered as zero in the calculation of Formulae (1) and (2).

With increasing combustion temperatures of recent years, the heat-resisting steel for engine valves of the present invention becomes possible to be applied, because of the excellent high temperature strength properties, in regions in which 21-4N steel or improved steels thereof can not be applied, for example, in a part of the region having utilized a γ' precipitation strengthening-type heat-resisting alloy up until now, and thus significant cost reduction can be attained.

EXAMPLES

The present invention will be described in more detail based on Examples below.

A heat-resisting steel for engine valves was melted in a vacuum induction melting furnace to form a 10 kg ingot, which was then heated to 1100° C. and subjected to hot forging to give a forged rod stock of 30 mm square. Furthermore, the product was held at 1130° C. for 20 minutes, subjected to a solution heat treatment of oil quenching, and then held at 750° C. for 100 minutes to perform an air-cooling aging treatment. Table 1 shows the chemical composition thereof.

Table 1

TABLE 1

(mass %)

| No | C | Si | Mn | P | Ni | Cr | W | Mo | Cu | Nb | N | B | Formula (1) | Formula (2) | Remarks |
|---|---|---|---|---|---|---|---|---|---|---|---|---|---|---|---|
| 1 | 0.34 | 0.30 | 1.02 | 0.28 | 10.47 | 20.08 | — | 0.49 | 0.20 | 0.10 | 0.157 | 0.0068 | 198 | 47 | Invention |
| 2 | 0.35 | 0.30 | 1.90 | 0.30 | 10.60 | 20.03 | — | 0.49 | 0.21 | 0.10 | 0.155 | 0.0052 | 201 | 47 | Invention |
| 3 | 0.35 | 0.30 | 1.03 | 0.31 | 10.60 | 20.15 | — | 0.50 | 0.21 | 0.10 | 0.175 | 0.0058 | 207 | 49 | Invention |
| 4 | 0.34 | 0.31 | 1.00 | 0.27 | 10.56 | 20.08 | — | — | 0.21 | — | 0.169 | 0.0054 | 198 | 51 | Invention |

TABLE 1-continued (mass %)

| No | C | Si | Mn | P | Ni | Cr | W | Mo | Cu | Nb | N | B | Formula (1) | Formula (2) | Remarks |
|---|---|---|---|---|---|---|---|---|---|---|---|---|---|---|---|
| 5 | 0.34 | 0.31 | 1.06 | 0.26 | 10.58 | 20.32 | — | 0.76 | 0.21 | 0.10 | 0.186 | 0.0065 | 202 | 48 | Invention |
| 6 | 0.34 | 0.30 | 1.00 | 0.26 | 10.63 | 20.06 | — | 1.52 | 0.21 | 0.10 | 0.188 | 0.0066 | 203 | 43 | Invention |
| 7 | 0.35 | 0.30 | 1.08 | 0.12 | 10.59 | 20.53 | 1.8 | 1.80 | 0.22 | 0.21 | 0.194 | 0.0074 | 183 | 31 | Invention |
| 11 | 0.32 | 0.27 | 1.00 | 0.19 | 10.56 | 20.16 | — | 2.18 | 0.20 | — | 0.042 | 0.0062 | 162 | 20 | Comp. Ex. |
| 12 | 0.34 | 0.30 | 0.99 | 0.02 | 10.51 | 20.31 | — | 0.50 | 0.21 | 0.10 | 0.086 | 0.0061 | 142 | 34 | Comp. Ex. |

(Note):
"—" represents being additive-free.
Remnants are Fe and unavoidable impurities.
Formula (1): calculated based on 156.42 P(%) + 0.91 Mo(%) + 0.73 W(%) − 12.27 Nb(%) + 220.96N(%) + 120.59.
Formula (2): calculated based on 13.70 P(%) − 6.97 Mo(%) − 4.32 W(%) − 3.29 Nb(%) + 119.10N(%) + 27.75
In Formulae (1) and (2), when W and/or Nb is not added, W and/or Nb is considered as zero in calculation.

For nine materials of Nos. 1 to 7, and Nos. 11 to 12 shown in Table 1, the hardness was measured at ordinary temperature and 800° C., a creep break test was carried out under the condition of 800° C. and 180 MPa, and a rotary bending fatigue test was carried out under the condition of 800° C. and 250 MPa. The hardness was measured with a Vickers hardness tester. For the creep rupture test, a test piece having a parallel part diameter of 30.0 mm was heated to 800° C., to which a tensile load of 180 MPa was applied, and a time until the rupture takes place was measured. For the rotary bending fatigue test, according to JIS Z2274, a test piece having a parallel part diameter of 8 mm was used and a rupture repetition number (times) of the test piece was searched at a rotation number of 3300 rpm. Table 2 shows results of various tests. Meanwhile, data of Nos. 4 to 7 and No. 12 shown in Tables 1 and 2 are newly added to those of the basic application.

Table 2

TABLE 2

| | Hardness (HV) | | 800° C.-250 MPa | | |
|---|---|---|---|---|---|
| No | Ordinary temperature | 800° C. | Rupture time (hr) | Rupture repetition number (times) | Remarks |
| 1 | 364 | 205 | 51.5 | 8052100 | Invention |
| 2 | 370 | 206 | 46.5 | 6578900 | Invention |
| 3 | 377 | 198 | 50.7 | 8856100 | Invention |
| 4 | 373 | 197 | 30.5 | 6937500 | Invention |
| 5 | 370 | 201 | 64.8 | 13109900 | Invention |
| 6 | 364 | 201 | 88.5 | 16948300 | Invention |
| 7 | 275 | 152 | 7.9 | 4426700 | Invention |
| 11 | 290 | 157 | 7.5 | 2268400 | Comp Ex. |
| 12 | 222 | 115 | 0.6 | 11600 | Comp Ex. |

From Table 2, it can be seen that the steel of the present invention exhibits higher values of the hardness at ordinary temperature and 800° C. and of the rupture time in the creep rupture test, thus having superior properties at high temperatures. For engine valves, generally, since the fatigue strength is particularly important among mechanical properties, it can be seen that the steel of the present invention exhibits high performance because it exhibits a higher fatigue strength than comparative steels.

A steel having a higher value of Formula (1) tends to be superior in the hardness and fatigue strength at high temperatures, which shows that the influence of the precipitation of P and N or the solid solution strengthening is great. Furthermore, the value of Formula (2) in Table 1 is an indicator representing the rough standard of the rupture time in the creep rupture test, and the value is greatly influenced by P and N.

As described above, in order to obtain the high temperature strength, by appropriately controlling the values of Formulae (1) and (2) through the use of the amount of alloying elements to be added, it becomes possible to utilize the precipitation strengthening and solid solution hardening to a maximum extent without causing the lowering of properties due to the influence of respective interactions.

INDUSTRIAL APPLICABILITY

As described above, the heat-resisting steel for engine valves according to the present invention is excellent in high temperature strength, and, since the steel is based on an Fe-based heat-resisting steel, it contributes to cost reduction and resource saving. Moreover, when the steel is used for automobile engine valves, it can greatly enhance the engine performance.

The invention claimed is:

1. A heat-resisting steel for engine valves excellent in high temperature strength, comprising:

in % by mass, C: 0.20 to 0.50%, Si: 1.0% or less, Mn: 5.0% or less, P: 0.1 to 0.5%, Ni: 8.0 to 15.0%, Cr: 16.0 to 25.0%, Cu: 0.03 to 0.5%, Nb: 0.03% or more and 1.0% or less, W: 2.0% or less (including 0%), Mo: 0.03% or more and less than 2.0%, N: 0.02 to 0.30%, B: 0.01% or less, and remnants of Fe and impurities, the heat-resisting steel for engine valves satisfying Formulae below:

$$156.42P(\%)+0.91Mo(\%)+0.73W(\%)-12.27Nb(\%)+220.96\,N(\%)+120.59\geq 170 \quad \text{Formula (1)}$$

$$13.70P(\%)-6.97Mo(\%)-4.32W(\%)-3.29Nb(\%)+119.10N(\%)+27.75\geq 30 \quad \text{Formula (2).}$$

2. The heat-resisting steel for engine valves excellent in high temperature strength according to claim 1, wherein the content of P is more than 0.15% and 0.5% or less.

3. The heat-resisting steel for engine valves excellent in high temperature strength according to claim 1, wherein the content of Mo is 0.03 to 1.6%.

4. The heat-resisting steel for engine valves excellent in high temperature strength according to claim 1, wherein the content of Mo is 0.03 to 1.0%.

5. The heat-resisting steel for engine valves excellent in high temperature strength according to claim 1, wherein the content of Nb is 0.03 to 0.2%.

6. The heat-resisting steel for engine valves excellent in high temperature strength according to claim 1, wherein the value of Formula (1) represented by 156.42 P(%)+0.91 Mo(%)+0.73 W(%)−12.27 Nb(%)+220.96 N(%)+120.59 is 185 or more.

7. The heat-resisting steel for engine valves excellent in high temperature strength according to claim 2, wherein the content of Mo is 0.03 to 1.6%.

8. The heat-resisting steel for engine valves excellent in high temperature strength according to claim 2, wherein the content of Mo is 0.03 to 1.0%.

9. The heat-resisting steel for engine valves excellent in high temperature strength according to claim 3, wherein the content of Mo is 0.03 to 1.0%.

10. The heat-resisting steel for engine valves excellent in high temperature strength according to claim 2, wherein the content of Nb is 0.03 to 0.2%.

11. The heat-resisting steel for engine valves excellent in high temperature strength according to claim 3, wherein the content of Nb is 0.03 to 0.2%.

12. The heat-resisting steel for engine valves excellent in high temperature strength according to claim 4, wherein the content of Nb is 0.03 to 0.2%.

13. The heat-resisting steel for engine valves excellent in high temperature strength according to claim 2, wherein the value of Formula (1) represented by 156.42 P(%)+0.91 Mo(%)+0.73 W(%)−12.27 Nb(%)+220.96 N(%)+120.59 is 185 or more.

14. The heat-resisting steel for engine valves excellent in high temperature strength according to claim 3, wherein the value of Formula (1) represented by 156.42 P(%)+0.91 Mo(%)+0.73 W(%)−12.27 Nb(%)+220.96 N(%)+120.59 is 185 or more.

15. The heat-resisting steel for engine valves excellent in high temperature strength according to claim 4, wherein the value of Formula (1) represented by 156.42 P(%)+0.91 Mo(%)+0.73 W(%)−12.27 Nb(%)+220.96 N(%)+120.59 is 185 or more.

16. The heat-resisting steel for engine valves excellent in high temperature strength according to claim 5, wherein the value of Formula (1) represented by 156.42 P(%)+0.91 Mo(%)+0.73 W(%)−12.27 Nb(%)+220.96 N(%)+120.59 is 185 or more.

* * * * *